United States Patent [19]

Holmes et al.

[11] 4,143,476

[45] Mar. 13, 1979

[54] DEVICE FOR ARRANGING AND TRANSPORTING ARTICLES OF LAUNDRY

[75] Inventors: John P. Holmes; Edward R. L. Nazareth, both of Pittsburgh, Pa.

[73] Assignee: Hospital Linen Service Facility, Pittsburgh, Pa.

[21] Appl. No.: 827,851

[22] Filed: Aug. 26, 1977

[51] Int. Cl.[2] ..... D06F 67/04; D06F 69/00

[52] U.S. Cl. ..... 38/7; 38/143

[58] Field of Search ..... 38/7, 143; 100/144, 100/214; 271/63; 198/464, 486

[56] References Cited

U.S. PATENT DOCUMENTS

| | | | |
|---|---|---|---|
| Re. 27,442 | 7/1972 | Weir | 38/143 |
| 3,509,649 | 5/1970 | Orkney et al. | 38/7 |
| 3,664,046 | 5/1972 | Thompson | 38/143 |
| 3,911,604 | 10/1976 | Sjostrom | 38/143 |

*Primary Examiner*—Louis Rimrodt

*Attorney, Agent, or Firm*—Webb, Burden, Robinson & Webb

[57] ABSTRACT

A device for arranging and transporting articles of laundry to feeder equipment for a flat ironing machine including a plurality of paired heads which are spaced apart pendent from a continuous chain. Each of the heads is provided with a pair of gripping devices for tautly holding a portion of the articles of laundry near the edges thereof whereby the articles can be picked off the heads by a feeder for continuous delivery to a flat ironing machine.

7 Claims, 5 Drawing Figures

DEVICE FOR ARRANGING AND TRANSPORTING ARTICLES OF LAUNDRY

This invention relates to a laundry apparatus and particularly to a device for arranging and delivering articles of laundry to feeder equipment for a flat ironing machine.

For many years the laundry art has relied upon manual labor to deliver articles of laundry to washing machines and then to ironing machines. Due to the high cost of labor, automatic equipment has been introduced to the commercial laundry art. One such piece of equipment is the large flat ironing machine, one form of which is capable of handling up to 1200 separate laundry articles including sheets, pillowcases and the like in one hour. To use the flat ironing equipment efficiently, laundry feeder machines have been developed. These machines grasp two corners of the laundry articles, hereinafter referred to as "flatwork," spread them apart to form a taut leading edge and lay the leading edge of the flatwork over a table conveyor. Blowers and drag rolls cause the trailing portions of the flatwork to be spread out upon the table conveyor without folds. The table conveyor then moves the flatwork to the ironing machine. Laundry articles are supplied to the feeding machines by hand, as in the case of the machines disclosed in Weir U.S. Pat. No. Re. 27,442 and Thompson U.S. Pat. No. 3,664,046 and others. Such laundry feeder machines, when supplied with laundry articles on a continuous basis, permit a flat ironer to approach its capacity. It has been found, however, that it is substantially impossible for human labor to continually supply laundry articles to such feeders at a rate required to provide the feeder with sufficient articles to maintain maximum capacity and complete efficiency in modern flat ironing machines. It is not unusual for the supply rate to be one article every three seconds. It is apparent that such a rate requires considerable human endurance even where a number of operators share the task. There has been a need for automatic equipment to supply the feeder for a flat ironer.

Briefly according to this invention, there is provided a device for arranging and transporting flatwork and the like at a very high delivery rate to the laundry feeder for delivery then to the flat ironing machine. This device comprises a plurality of heads carried by a continuous belt or chain. The heads are appropriately spaced apart and include pairs of jaws or grippers for releasably holding laundry articles to be supplied to a laundry feeder for subsequent delivery to a flat ironing machine. The heads with associated jaws permit a laundry article to be placed thereon by hand and held there until it is picked off by a mechanism carried by the laundry feeder. The continuous belt is driven by a variable speed motor adjusted in accordance with the speed of the laundry feeder. The device for arranging and transporting is synchronized with the laundry feeder through the use of limit switches or the like.

Figure 1:
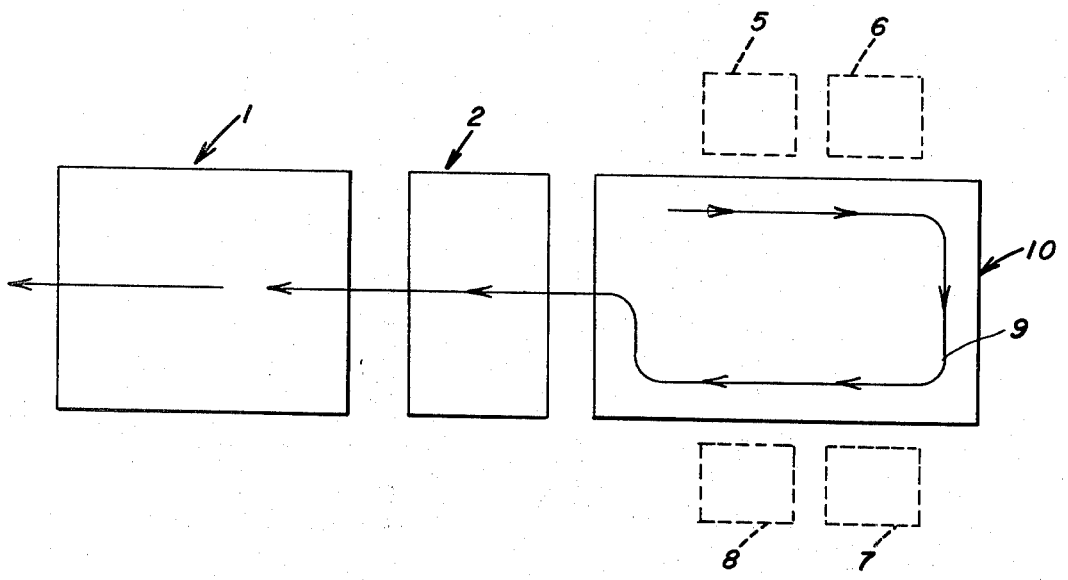
Figure 5:
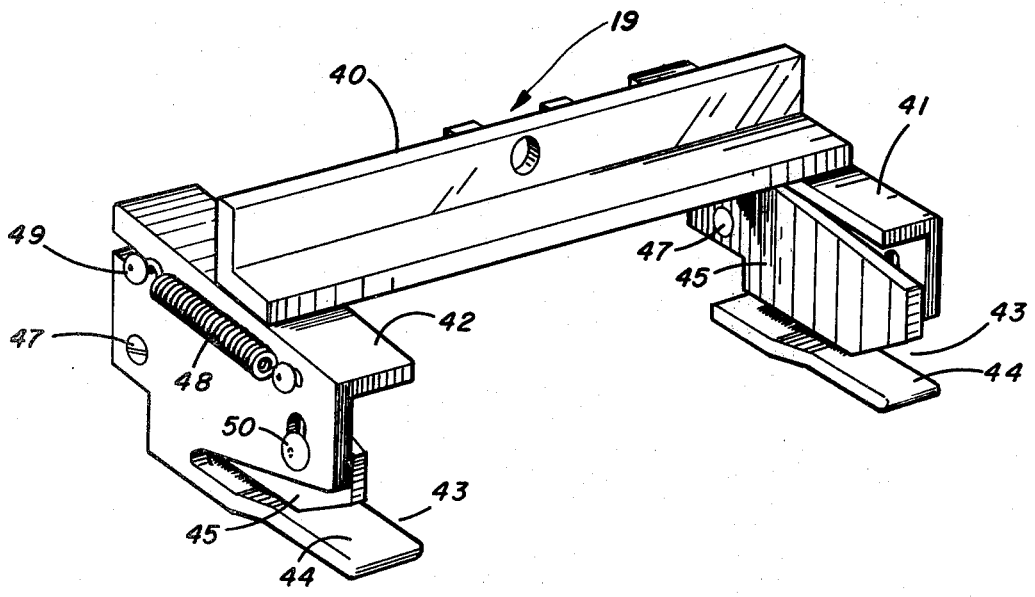
Figure 2:
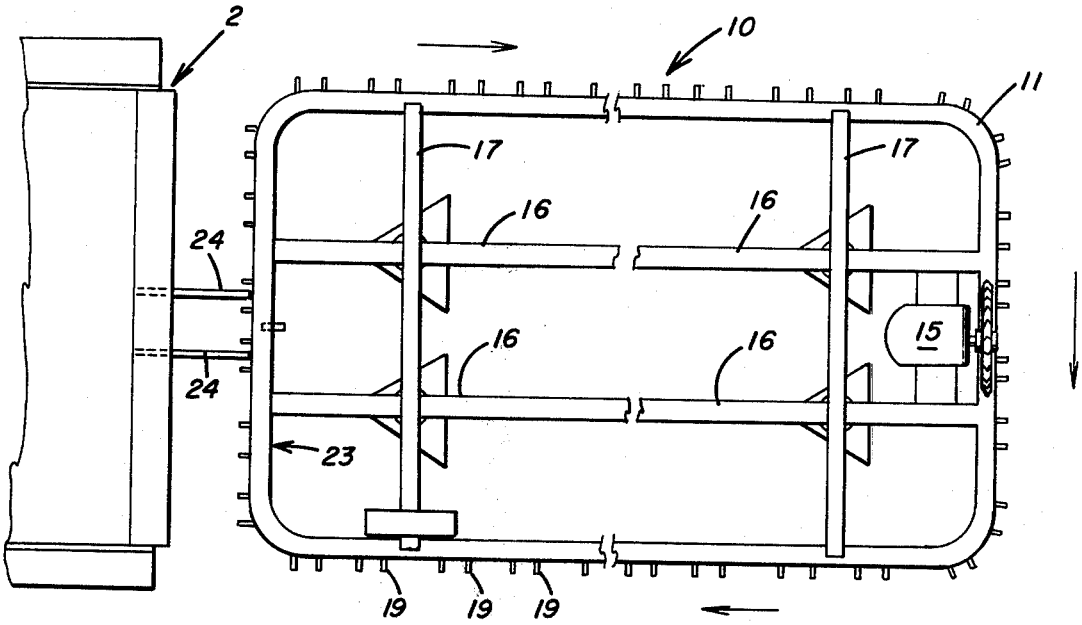
Figure 3:
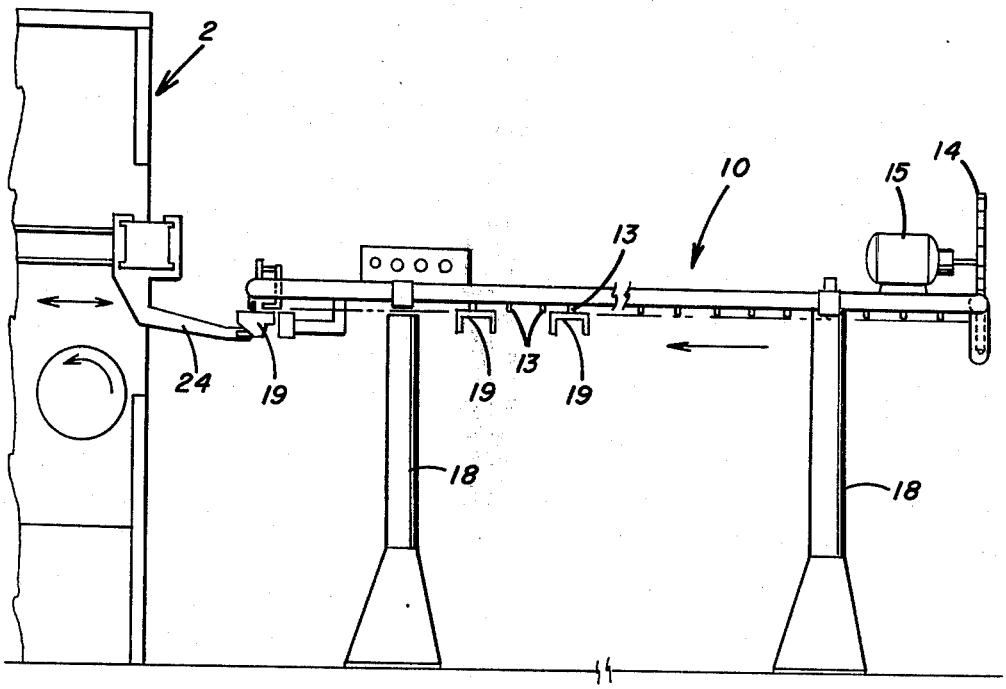
Figure 4:
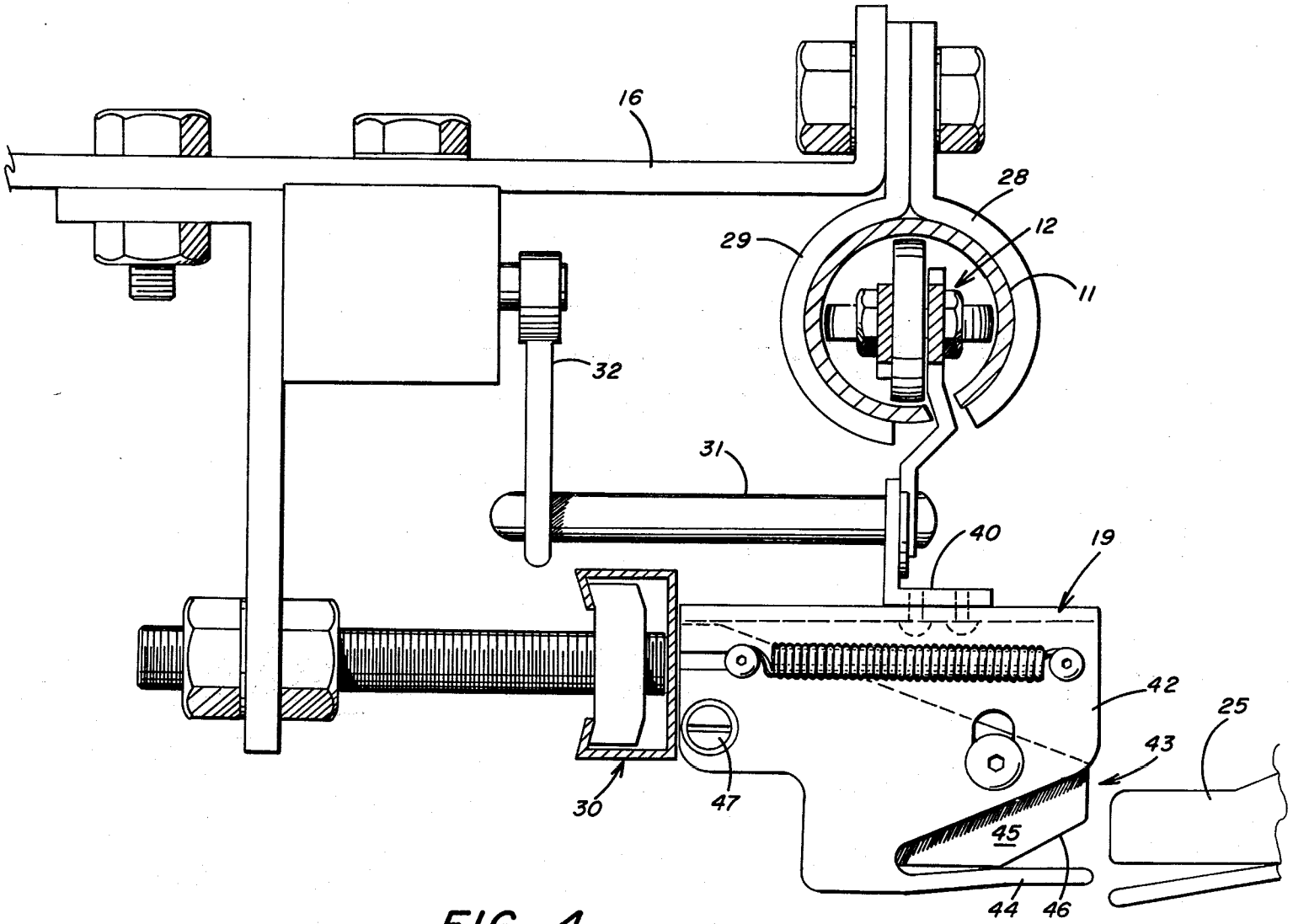

Further features and other objects and advantages of this invention will become clear from the following detailed description made with reference to the drawings in which FIG. 1 is a schematic plan view showing the overall relationship of the ironer, feeder and arranging and transporting devices according to this invention, FIG. 2 is a plan view of one embodiment of the arranging and transporting device according to this invention juxtaposed with a feeder for delivering laundry to a flat ironer, FIG. 3 is an elevation view of the apparatus shown in FIG. 2;

FIG. 4 is an enlarged section of a portion of the conveyor showing a side view of one of the heads, and FIG. 5 is a perspective view of one head.

Referring now to FIG. 1, the overall arrangement of a system for ironing flatwork or the like is illustrated. The ironing machine 1, is fed by a feeder 2 which presents the flatwork to the ironer on a table conveyor or the like laid out in a plane without folds. These apparatus are known in the art and have the capability of handling about 1200 items of flatwork per hour. The feeder to perform its function, must grasp two adjacent corners of the flatwork. No machine exists for pulling laundry from a basket. This task must still be performed manually by operators that reach into the basket, isolate one item, first find one corner of the item and then the adjacent corner. This done, two adjacent corners can be presented to the feeder arms and clamps. In the past, the operator or operators have stood before the feeder presenting sorted flatwork to it. According to this invention, an arranging and transporting device 10 is placed between the operators located at stations 5, 6, 7 and 8, for example, and the feeder. The flow of flatwork from the operator stations to the ironer and therethrough is illustrated by the line 9 with spaced arrow heads indicating the direction of flow. The arranging and transporting device enables a plurality of operators to present flatwork to the feeder and facilitates the operators' task of locating adjacent corners of the flatwork in that the operator finds one corner and presents it to the arranging and transporting device and then with two hands available finds an adjacent corner for presenting to the device.

Referring now to FIGS. 2 and 3, there are shown plan and side views respectively of arranging and transporting device 10. A conveyor guide 11 forms a generally rectangular track with rounded corners. Within the conveyor guide is a continuous conveyor chain 12 or the like. The conveyor guide 11 is preferably of tubular configuration with a slot near the bottom thereof for permitting arms 13 pendent from the conveyor chain to pass therethrough. The chain, engages a drive sprocket 14 which is driven by a variable speed motor 15. The motor and drive sprocket cause the chain to orbit within the generally rectangular conveyor guide.

The conveyor guide 11 is supported by a frame comprising longitudinal beams 16 and crossbeams 17. The frame and conveyor guide are held in a generally horizontal plane elevated above the floor by uprights 18. The conveyor and frame are positioned adjacent the feeder 2. Preferably, one side 23 of the generally rectangular conveyor guide faces the feeder.

The feeder 2 has arms 24 with clamps 25 at the end thereof for grasping the flatwork. The operation of the feeder is as disclosed in the prior art; that is, the arms 24 spread apart two corners of the flatwork forming a taut leading edge which is then laid over a roll or conveyor table. Drag rolls and/or blowers spread the trailing portions of the flatwork upon the conveyor table. The initial action of the feeder is to move the relatively closely spaced arms 24 and clamps 25 to a "pick off" position (as shown in FIGS. 1 and 2). This movement of the arms is always from the feeder generally opposite the direction of flow of the flatwork from the feeder to ironer. The conveyor chain is generally moving perpendicular to the movement of the arms in the vicinity of the feeder. The chain does not slow or stop during the pick off operation but the feeder grasps the flatwork on the fly. The feeder clamps are spring-loaded to snap shut when engaging a taut edge and approach the arranging and transporting device with jaws open.

Pendent arms 13 extend down from the conveyor chain 12 approximately every six inches. Attached to the spaced pendent arms are heads 19. The heads 19 are spaced apart approximately 24 inches (hence, two empty pendent arms are positioned between each pair of heads). Each head 19 supports a pair of spaced jaws approximately six inches apart. Now then, the heads may be centered on the pendent arms or if the feeder arms 24 are spaced closer together than 24 inches the heads may be mounted offset in which case the pairs of heads are shifted closer together without altering the chain and/or the pendent arms.

Referring now to FIG. 4, there is illustrated a section view of the conveyor guide 11 and chain 12 just in front of the feeder. The clamps 25 of the feeder are shown with jaws open approaching the pick off. The head 19 is shown in side view. The conveyor chain guide 11 is held by brackets 28 and 29, for example as shown in FIG. 4, to the longitudinal frame members 16. The heads 19 are guided in front of the feeder by sled 30 which is secured to the frame. In this way, the heads cannot be pushed away from the clamps during the exchange of flatwork from the heads 19 to the feeder clamps 25. Attached to at least one pendent arm associated with each pair of heads or attached to one of the pendent arms spaced therebetween is a pin 31 which moves a stationary lever 32 as it passes thereby. The action of the pin and lever activates the pick off by the feeder. Hence, each pair of heads is mechanically indexed to the feeder as it passes by assuring synchronization of the pick off. Numerous other indexing schemes i.e., those using photocells or magnetically activated switches can be substituted for the pin and lever.

Referring now to FIGS. 4 and 5, the structure of the gripper heads will be explained. Each gripper head comprises spacer bar 40 to which a right side piece and a left side piece 41 and 42 respectively are fastened. Each side piece is more or less channel shaped with the channel webs facing inwardly. Notches 43 open away from the front of the heads. One edge of the notch corresponds with the top of the lower web 44 on each side piece. The lower web thereby defines a lower clamp jaw. Pivotally mounted to each side piece is an upper jaw 45 which has a taper 46 away from the front of the jaws facilitating the easy insertion of flatwork between the upper and lower jaws. The upper jaws are pivotally mounted at 47 and biased against the lower jaw by a spring 48 secured to the upper jaw at 49 and the side piece at 50. The head 19 thereby comprises two spaced pairs of jaws spring-biased together.

OPERATION

As the first head of a pair of heads is moved to an operator station, the operator, using both hands manually, places a taut portion of an edge of a piece of flatwork between the spaced pairs of jaws. The operator then can run her hands along the edge finding the other corner. By this time, the other head in the pair is opposite the operator and another taut portion of the edge can be inserted between a spaced pair of jaws. The flatwork then hangs draped between the two heads ready for pick off when the pairs of heads reach the feeder. The pairs of heads are preferably marked with indicia, so that operators do not drape the flatwork between heads of adjoining pairs. Typically, the heads are color coded, the number of colors corresponding to the number of operators. If the arranging and transporting device is designed for four operators, then the heads of succeeding pairs are differently colored, say, red, green, blue and yellow. This sequence of colors is repeated along the chain. Each operator is assigned to drape flatwork on the pairs of a given color. It should be apparent that the number of head pairs around the chain should be an integral multiple of the number of operator stations. The flatwork arranged on a gripper head pair is then carried to the feeder. The feeder is presented two taut portions of one edge of the flatwork. Actually, the feeder is presented two taut 90 degree folds and the feeder clamps reach into the space between the jaws of the heads pushing the fold together and, due to the snap action of the clamps grap the fold tightly between two jaws. The time for the feeder clamp to move in and out of the space between the two jaws of the heads is determined by the speed of the conveyor and the space between the heads. Now then, the jaws on the feeder clamp grasp the flatwork with considerable pressure. (The jaws must be opened by a cam mechanism at an appropriate time.) Therefore, as the clamps of the feeder are withdrawn from the heads of the arranging and transporting device, the flatwork is pulled from the heads having a much weaker grip thereon thus exchanging the flatwork from the transporting device to the feeder.

Having thus described our invention with the detail and particularity as required by the Patent Laws, what is desired protected by Letters Patent is set forth in the follow claims.

We claim:

1. In a system for automatically feeding flatwork, laundry or the like to an ironing machine which comprises a feeder that grasps two corners of one edge of the flatwork, spreads the corners and lays the edge on a device for moving the flatwork to the ironing machine, the improvement comprising an arranging and transporting device upon which the flatwork may be manually hung at spaced operator stations by a plurality of operators and advanced past the feeder whereat it is taken by the feeder, said arranging and transporting device comprising a continuous chain, a frame for supporting the continuous chain and means for orbiting the chain past said operator stations and the feeder, spaced pairs of heads secured to the chain, said heads having spaced pairs of jaws into which a portion of the edge of the flatwork near the corners of said edge may be forced such that each head presents a taut portion of the flatwork, means synchronizing the feeder and the arranging and transporting device such that the feeder may enter the continuously moving heads to grasp the taut portion of the flatwork held therein and withdraw with the flatwork.

2. The improvement according to claim 1 wherein the frame comprises a tubular chain guide having a slot along the underside thereof, said chain being positioned within the chain guide with pendent arms extending through said slots securing the heads to the chain.

3. The improvement according to claim 1 wherein the chain guide causes the chain to travel in a more or less rectangular path with one side parallel to the feeder and operator stations arranged along other sides.

4. The improvement according to claim 1 wherein heads comprising a functional pair are spaced apart about 1 to 3 feet on center and the jaws associated with a given head are spaced apart 3 to 12 inches.

5. The improvement according to claim 4 wherein the function pairs carry identifying indicia so that each operator can easily select the pair or pairs upon which she has been assigned to arrange flatwork.

6. The improvement according to claim 1 wherein the jaws of the heads open toward the feeder and the operators stationed outside the orbiting chain and where the taut portion of the flatwork presented to the picker is a fold of about 90°.

7. A head useful in a system for automatically feeding flatwork, laundry or the like to an ironing machine which comprises a feeder that grasps two corners of one edge of the flatwork, spreads the corners and lays the edge on a device for moving the flatwork to the ironing machine, and including the improvement comprising an arranging and transporting device upon which the flatwork may be manually hung at spaced operator stations by a plurality of operators and advanced past the feeder whereat it is taken by the feeder, said arranging and transporting device comprising a continuous chain, a frame for supporting the continuous chain and means for orbiting the chain past said operator stations and the feeder, spaced pairs of heads secured to the chain, and means synchronizing the feeder and the arranging and transporting device, said head comprising a spacer bar arranged to be secured to an arm pendant from the chain, right and left sides secured to the spacer bar, each side having a notch opening in the same direction, the lower edge of each notch defined by a flat, generally horizontal web being the lower jaw, an upper jaw pivotally mounted to each side and arranged to press a part of the flatwork against the web, whereby a portion of the flatwork can be laid tautly across each web without unduly stressing the flatwork and whereby the feeder may enter the continuously moving heads to grasp the taut portion of the flatwork held therein and withdrawn with the flatwork.

* * * * *

UNITED STATES PATENT AND TRADEMARK OFFICE

CERTIFICATE OF CORRECTION

PATENT NO. : 4,143,476
DATED : March 13, 1979
INVENTOR(S) : John P. Holmes et al.

It is certified that error appears in the above-identified patent and that said Letters Patent are hereby corrected as shown below:

Column 4 Line 19 "grap" should read --grab--.

Claim 2 - Column 4 Line 61 "slo" should read --slot--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*